US009254445B2

(12) United States Patent
Berk

(10) Patent No.: US 9,254,445 B2
(45) Date of Patent: Feb. 9, 2016

(54) INTERACTIVE ENTERTAINMENT DEVICE FOR LIGHTER-THAN-AIR BALLOONS

(71) Applicant: Jed Berk, Los Angeles, CA (US)

(72) Inventor: Jed Berk, Los Angeles, CA (US)

( * ) Notice: Subject to any disclaimer, the term of this patent is extended or adjusted under 35 U.S.C. 154(b) by 0 days.

(21) Appl. No.: 14/354,882

(22) PCT Filed: Oct. 29, 2012

(86) PCT No.: PCT/US2012/062485
§ 371 (c)(1),
(2) Date: Apr. 28, 2014

(87) PCT Pub. No.: WO2013/063606
PCT Pub. Date: May 2, 2013

(65) Prior Publication Data
US 2014/0302742 A1 Oct. 9, 2014

Related U.S. Application Data

(60) Provisional application No. 61/552,939, filed on Oct. 28, 2011.

(51) Int. Cl.
*A63H 27/10* (2006.01)

(52) U.S. Cl.
CPC ..... *A63H 27/10* (2013.01); *A63H 2027/1008* (2013.01); *A63H 2027/1041* (2013.01)

(58) Field of Classification Search
CPC ..... A63H 2027/1008; A63H 27/087; A63H 27/002; A63H 29/24
USPC ..... 446/220, 191, 229, 30–33, 225; 81/318–320, 324, 464, 54; 242/170, 242/390.2, 347, 588, 588.1–588.3
See application file for complete search history.

(56) References Cited

U.S. PATENT DOCUMENTS

| | | | | |
|---|---|---|---|---|
| 3,075,722 | A * | 1/1963 | Stealy et al. | 242/225 |
| 3,202,378 | A * | 8/1965 | Williamson | 242/390.8 |
| 3,592,157 | A | 7/1971 | Schwartz | |
| 3,593,940 | A * | 7/1971 | Stanton | 242/390.8 |
| 3,805,444 | A | 4/1974 | Adickes | |
| 3,822,839 | A | 7/1974 | Persichini | |
| 4,693,695 | A | 9/1987 | Cheng | |
| 5,188,314 | A | 2/1993 | Peters | |
| 5,238,200 | A | 8/1993 | Ritzenthaler | |
| 5,240,199 | A * | 8/1993 | Peters | 242/405.1 |
| 5,411,427 | A | 5/1995 | Nelson et al. | |
| 5,662,510 | A | 9/1997 | Wolens | |
| D414,222 | S | 9/1999 | Ansolabehere | |

(Continued)

FOREIGN PATENT DOCUMENTS

| | | |
|---|---|---|
| DE | 2902559 | 2/1979 |
| DE | 2902559 A1 * | 8/1979 |

(Continued)

OTHER PUBLICATIONS

International Search Report and Written Opinion, International Patent Application No. PCT/US2012/062485, Jan. 22, 2013.

*Primary Examiner* — Gene Kim
*Assistant Examiner* — Rayshun Peng
(74) *Attorney, Agent, or Firm* — Loza & Loza, LLP; Michael Fedrick

(57) ABSTRACT

A hand-held interactive entertainment device which winds and unwinds a lighter-than-air balloon on a tether by applying pressure to the device.

18 Claims, 11 Drawing Sheets

(56) References Cited

U.S. PATENT DOCUMENTS

| | | | | |
|---|---|---|---|---|
| 5,947,790 | A * | 9/1999 | Gordon | 446/247 |
| 5,598,909 | A | 11/1999 | Frazier | |
| 6,039,456 | A * | 3/2000 | Chabria | 362/189 |
| 6,065,709 | A | 5/2000 | Stuyver et al. | |
| 6,076,758 | A | 6/2000 | Ansolabehere | |
| 6,327,994 | B1 | 12/2001 | Labrador | |
| 6,716,083 | B1 | 4/2004 | Castro | |
| 7,178,754 | B2 | 2/2007 | Anderson | |
| 7,195,534 | B1 | 3/2007 | Millman | |
| 7,674,152 | B2 | 3/2010 | Anderson | |
| 8,578,999 | B2 * | 11/2013 | Kropp | 156/577 |
| 2003/0197084 | A1 | 10/2003 | Anderson | |
| 2008/0242190 | A1 | 10/2008 | Hofer | |
| 2010/0107992 | A1 | 5/2010 | Chefetz | |
| 2010/0219279 | A1 * | 9/2010 | Doring | 242/390.2 |

FOREIGN PATENT DOCUMENTS

| | | |
|---|---|---|
| JP | 10262707 | 6/1998 |
| RU | 59429 | 12/2006 |

* cited by examiner

INTERACTIVE ENTERTAINMENT DEVICE FOR LIGHTER-THAN-AIR BALLOONS

CROSS-REFERENCE TO RELATED APPLICATIONS

This application is the U.S. national stage of International Patent Application No. PCT/US2012/062485, filed on filed Oct. 29, 2012 and entitled INTERACTIVE ENTERTAINMENT DEVICE FOR LIGHTER-THAN-AIR BALLOONS, which claims the benefit of priority under 35 U.S.C. §120 from U.S. Patent Application No. 61/552,939, filed Oct. 28, 2011. The disclosures of the foregoing applications are incorporated herein by reference in their entirety.

BACKGROUND

Balloons are used for various purposes, including for entertainment, advertising, display, and for decorations at parties or other occasions. Lighter-than-air balloons are typically filled with helium, but may be filled with any lighter-than-air gas in order to allow such balloons to float in air. The balloons may be made from a variety of materials, including natural or synthetic rubber, polyester, metallized polyester, nylon, or metallized nylon.

Lighter-than-air balloons are sometimes tethered by a string or ribbon to a weight. A variety of balloon weights have been developed. Such weights typically include a weight of predetermined weight, a length of ribbon, and sometimes a means to attach the balloon to the ribbon. Examples of such weights are disclosed in U.S. Pat. Nos. 5,989,093 and 6,076,758 and U.S. Patent Publication No. 2003/0197084. There remains a need, however, for balloon weight systems having improved functionality.

FIGURES

SUMMARY

Figure 1:
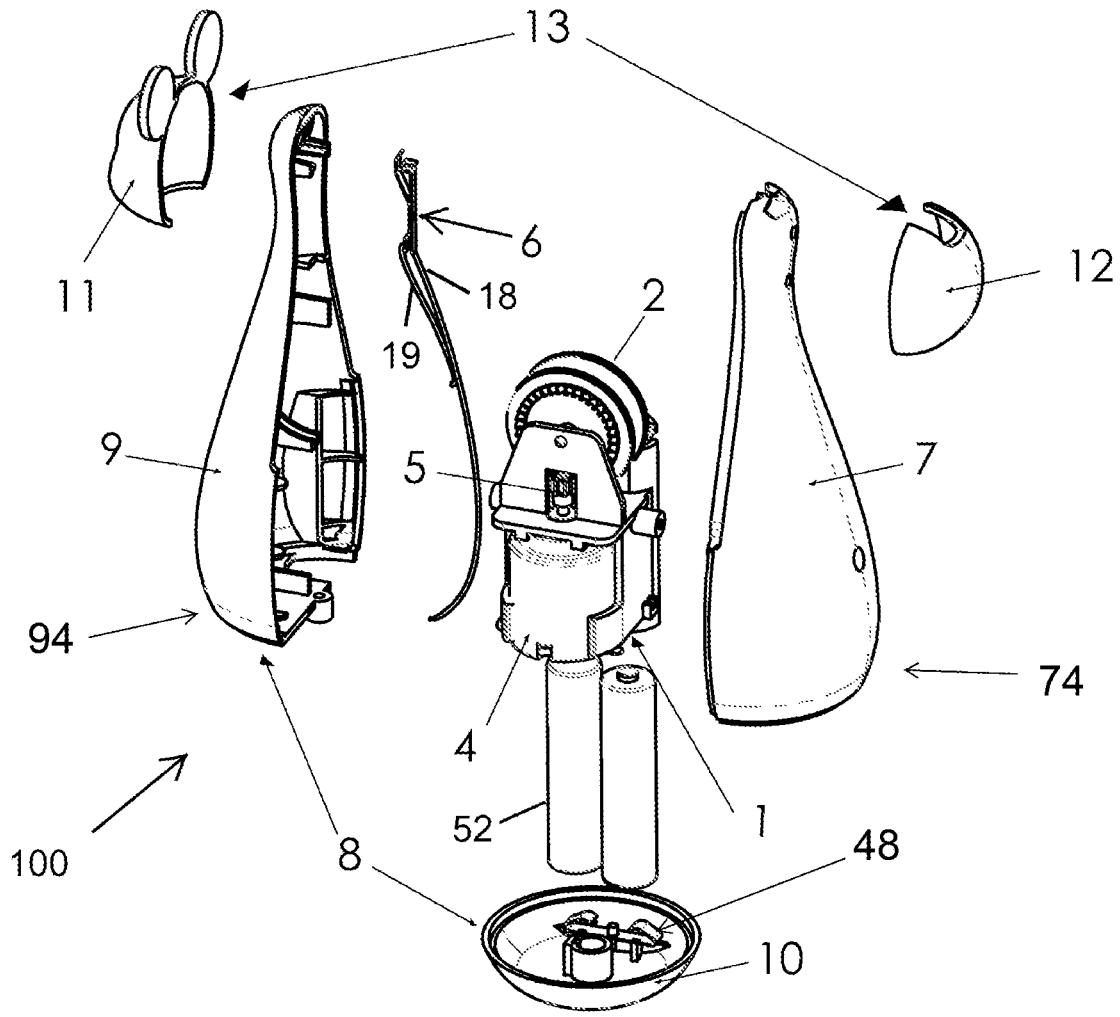
FIG. 1 is an exploded perspective view of the present device having a drive mechanism for retraction of cordage.

The present invention relates to an anchor for fixedly tethering a balloon and fulfills a need for a device that acts both as a practical balloon weight and that enhances the play experience of a user with a balloon. The present device is an interactive entertainment device for lighter-than-air balloons which includes the following components:

(a) a tether having a first end connected to a balloon and a second end attached to a reel;

(b) a motor mechanically connected to the reel;

(c) a pressure-activated switch in electrical communication with the motor, the switch comprising a pair of separated contact surfaces, the application of pressure to the switch results causes the separated contact surfaces to come into electrical communication and complete an electrical connection between the motor and an electrical source, and the motor is activated when the electrical connection is made;

(d) a housing, the housing having an upper portion enclosing the pressure-activated switch and a lower portion enclosing the motor and the reel and including (i) an opening in the upper portion through which the tether extends and (ii) an inwardly projecting flange provided on the interior of the upper portion of the housing, the flange is mechanically connected to one of the contact surfaces. In this device, the reel freely rotates around an axis in one direction so as to allow the tether to unwind in response to an upward force exerted by the rising of a lighter-than-air balloon, and the motor rotates the reel around the axis in the opposite direction so as to wind the tether around the reel when the motor is activated.

In a preferred embodiment, the housing comprises a first lateral portion and a second lateral portion. In such an embodiment, when the tether is a ribbon, one or more inwardly projecting flanges on the first lateral portion of the housing adjacent to the opening in the upper portion of the housing can be placed facing one or more inwardly projecting flanges on the second lateral portion of the housing adjacent to the opening in the upper portion of the housing to help to prevent twisting of the ribbon. Each of the lateral portions of the housing can also comprise a pair of parallel, inwardly projecting vertical walls spaced apart so as to accommodate the reel and a lower wall for retaining the reel, thereby forming a spool guide.

In addition, a clip attached to the tether can be used to prevent inadvertent activation of the motor. The proximal end of the clip can be attached to the free end of the tether, and the clip is sized to fit within the opening in the upper portion of the housing and prevent movement of the first lateral portion and the second lateral portion of the housing toward each other, thereby preventing activation of the pressure activated switch. The distal end of the clip can be attached to a second tether which is attached to a balloon.

Preferably, at least the upper portion of the housing is formed from an elastically deformable material. In this way, the application of pressure to the upper portion of the housing results in lateral movement of the inwardly projecting flange and causes the separated contact surfaces to come into electrical communication and activate the motor. The motor preferably comprises a drive shaft having teeth at a distal end, and the drive shaft teeth mesh with teeth disposed on the reel, thereby driving rotation of the reel by the motor.

The housing's center of gravity is preferably located in the lower portion of the housing, the lower portion comprising radiused lower edges on an exterior surface so that the device can return to an upright position if tipped over. This can be accomplished by locating the motor and/or batteries in the lower portion of the housing. In some embodiments, a covering for the upper portion of the housing can be included, the covering including an opening to allow passage of the tether therethrough.

DESCRIPTION

Definitions

As used herein, the following terms and variations thereof have the meanings given below, unless a different meaning is clearly intended by the context in which such term is used.

"Balloon" refers to a flexible enclosure used for entertainment, display, or aesthetic purposes, which has an opening through which gas can be conveyed from outside the balloon in order to inflate the enclosure. Balloons are adapted to be inflated either with a heated gas or gas mixture (such as air) or with a gas, such as helium, that is lighter than the surrounding air, thereby causing the balloon to rise and float in the atmosphere.

"Flange" refers to a flat rim, rod, or rib projecting from a surface of an object.

"Lead" refers to an electrical connection consisting of a length of wire or other conductive material.

"Mechanically connected" means physically connected, either through a connection based on direct physical contact or via another physical structure.

"Reel" refers to a cylinder, frame, or other structure that turns on an axis and is used to wind up or unspool a tether.

"Ribbon" refers to a strip of flexible material of relatively uniform width having a length that is significantly greater than its width.

"Tether" refers to a rope, chain, cord, ribbon, line, or similar length of material or connected links which is fastened to a fixed object so as to limit its range of movement.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Entertainment Device

The present invention comprises a hand-held interactive entertainment device 100 for use with a lighter-than-air balloon 37. The device allows a user to interact with a tethered balloon in the manner of a yo-yo, albeit upside down, by reeling the balloon in and out. A squeeze of the device causes the balloon to be reeled in by a motor, while releasing the device causes the balloon to rise due to the upward force provided by lighter-than-air gas in the balloon. The present device also acts as a balloon weight.

A balloon 37 for use with the present device 100 can be filled with air or, more preferably, can be filled with a gas that is lighter-than-air and that is not readily combustible such as helium. The balloon can be formed of materials such as natural or synthetic rubber, but for balloons filled with a lighter-than-air gas it is desirable for the material to provide a barrier to the passage of the gas. When the lighter-than-air gas is helium, for example, the balloon can be made from a film including a layer of metal, EVOH and/or PVDC. Preferably, the balloon material is a metalized polyester or a metalized nylon and most preferably a metalized poly(ethylene terephthalate) (PET). Suitable PET includes the material sold by Dupont under the trademark MYLAR.

FIG. 1 is an exploded view of the present device 100 having a drive mechanism for retraction of a tether 3 housed in a housing or body 8. The present device 100 comprises a chassis 1 which holds a ribbon and reel assembly 2 that rotates freely clockwise and counterclockwise to wind in and out a tether 3, which can be a ribbon (as shown, e.g., in FIGS. 2A-2B). The chassis 1 secures the motor 4, drive shaft 45, drive gear 5 and reel assembly 2 and is constructed with openings or receptacles having electrical contacts 48 to secure one end of batteries 49 in place (see FIG. 2B).

The housing 8 is preferably molded and formed from a polymer material, although other materials can also be used. In the embodiment illustrated in the figures, the housing formed from three molded parts, housing side "A" (9), housing side "B" (7), and batter cover 10. Housing side "A" 9 and housing side "B" 7 are assembled around the chassis 1 and enclose the reel assembly 2, motor 4, drive gear 5, batteries 49, and contact switch 6, as shown in FIG. 1. The contact battery cover 10 covers the lower portion 74 of housing side "B" 7 and lower portion 94 of housing side "A" 9 and is constructed to fit onto and be attached to one or both of housing side "A" and housing side "B". A contact switch 6 is preferably secured to housing side "B" 7 and is activated when the housing body 8 is pressed or squeezed (discussed further below). A head attachment 13, comprising head front section 11 and head back section 12, can be attached to the upper portion 82 of the housing body 8 (also discussed further below).

Figure 2A:
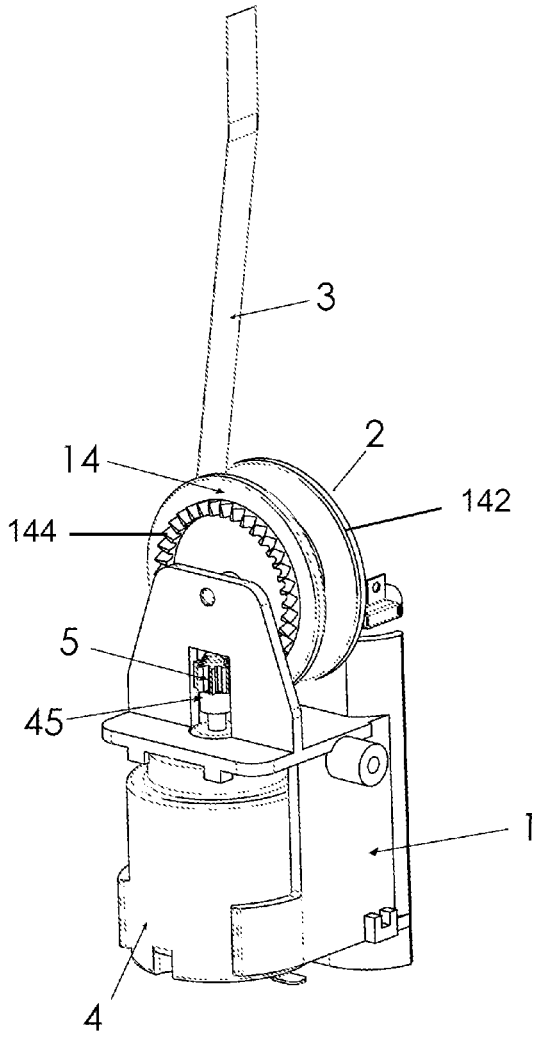
FIG. 2A is a perspective view of the drive mechanism of the present device.
Figure 2B:
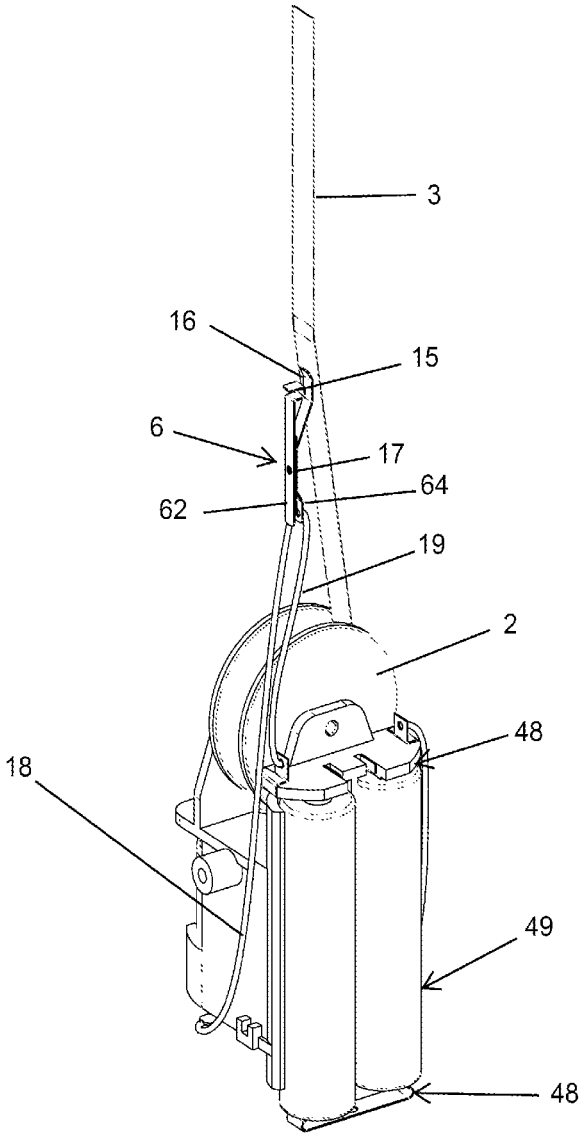
FIG. 2B is a perspective view of the activation mechanism of the present device.

FIGS. 2A and 2B show the drive mechanism and reel assembly of the present device. The drive mechanism comprises a motor 4, secured to the chassis 1, which actuates a drive shaft 45 having a gear 5 at a distal end. The reel assembly 2, which comprises a reel 142 and teeth 144, is mechanically connected to the gear 5, preferably by meshing of teeth on gear 5 with teeth 144 on the reel assembly 2. When the motor is actuated, the teeth 144 on gear side 14 mate with the teeth on drive gear 5 and wind a ribbon or other tether 3. Preferably, the motor 4 is a brush type electric motor, or alternatively can be a stepper motor.

In an alternative embodiment, the shaft 45 can be attached to the reel 142 with a belt or chain, through gears, or in other ways known to the art. The reel can rotate at the same speed as the shaft or at higher or lower rotational speeds, as determined by the mechanism linking the shaft to the reel. In a preferred embodiment, a gear disengaging mechanism, such as a centrifugal-clutch or clutch mechanism, is employed to reduce the friction of gears mating/meshing in relation to the motor's cogging torque. When the motor is activated, the reel 142 is rotated to wind the tether 3. While the motor is off, the tether 3 drawn upward by the lifting force of the lighter-than-air balloon, and the reel rotates in the opposite direction. In an alternative embodiment, a microprocessor or other circuit can be preprogrammed to operate the motor so as to reel in a predetermined length of the tether 3. An aesthetic or entertaining effect can be achieved by programming the circuit to reel in the tether a plurality of times in series over predetermined distances, which may be the same or different. The circuit can likewise preferably be programmed to turn off the motor when a clip 31, balloon 37, or other item attached to the free end of the tether 3 contacts the housing 8 (e.g., in response to an increased load on the motor).

Figures 3A, 3B:
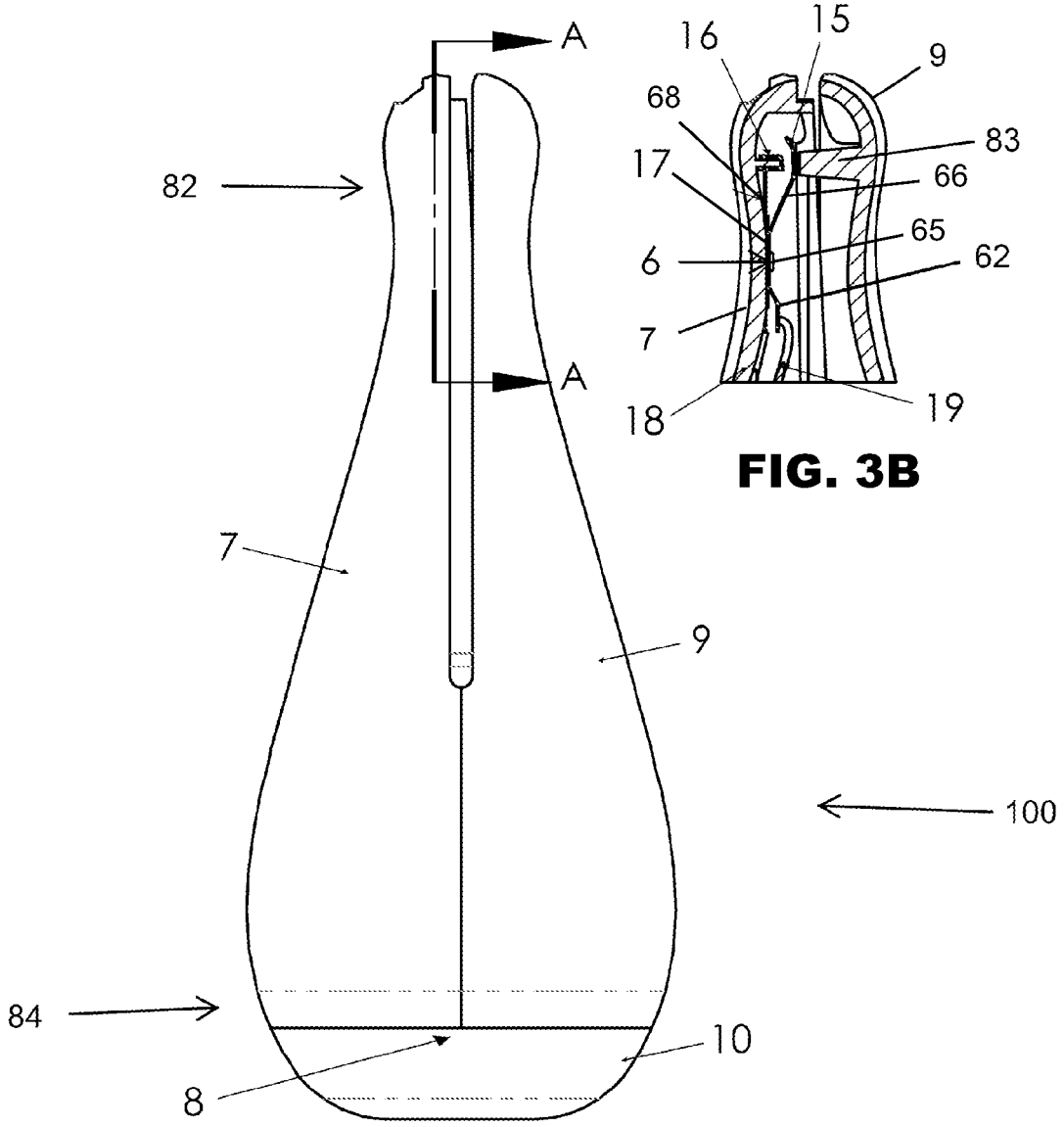
FIG. 3A is a plan view of the switching mechanism of the present device.
FIG. 3B is a cross-sectional view along line A-A of FIG. 3A.

FIGS. 2B and 3B illustrate the switching mechanism of the present device. In the illustrated embodiment, the on/off switch for the motor 4 is a contact switch 6 which comprises an electrically conductive first half 62 and an electrically conductive second half 64 separated by a non-conductive material 17. A first lead 18, which is in electrical communication with the first half 62 of the switch 6, places the switch 6 in electrical communication with the motor 4, while the second lead 19, which is in electrical communication with the second half 64 of the switch 6, places the switch in electrical communication with the batteries 49. An electrical contact surface 15 on the first half 62 of the switch is placed in close proximity to a second electrical contact surface 16 on the second half 64 of the switch 6, preferably such that contact surface 15 faces contact surface 16.

As shown in FIG. 3B, contact surface 15 can be part of or attached to an arm 66, while contact surface 68 can be part of or attached to an arm 68, and the arms 66 and 68 are joined at a junction 65. In order to activate the switch 6 and complete an electrical circuit in this embodiment, to provide electrical current to the motor, the contact surfaces 15 and 16 are brought into contact with one another. Preferably, one or both of the arms 66 or 68 is elastically deformable, so that the surfaces 15 and 16 can be brought into contact (to activate the motor) when pressure or other force is applied to them but so that the arms 66 and 68 resist such force and resume a separated configuration following the removal of the force, thereby making the default condition of the switch "off" when no external pressure is applied to the arms 66 and/or 68.

The contact switch 6 is preferably fastened to a portion of the housing 8 which is elastically deformable, in order to allow the switch to be activated. The elastically deformable material is preferably a polymer material, but can be any material known to the art. In a preferred embodiment, the housing 8 is formed from a polymer material which is sufficiently rigid to maintain the shape of the housing 8 during normal use by a user, but which is elastically deformable in order to allow the switch to be activated through pressure on a portion of the housing. In order to accomplish such pressure activation, the switch can be attached to housing side "B" 7, as shown in FIG. 3B. When housing side "A" 9 and housing side "B" 7 are pressed or squeezed toward each other in this embodiment, contact surface 15 on the first half 62 of the switch is placed in contact with the second electrical contact surface 16 on the second half 64 of the switch and completes the circuit, thereby allowing electricity to flow to the motor and activate the motor.

An inwardly projecting flange 83 is preferably provided on the interior of the housing, such as on housing side "A" 9, in order to convey pressure from one side of the device 100 to the contact switch 6 and bring the contact surfaces 15, 16 into electrical contact. As shown in FIG. 3B, when pressure is applied to housing side "A" 9, the inwardly projecting flange 83 is moved inwardly, and when it contacts the contact surface 15 (if it is not already attached or otherwise mechanically connected to contact surface 15) the pressure from the inwardly projecting flange 83 moves the contact surface 15 laterally until it makes contact with contact surface 16, thereby activating the motor. When pressure on inwardly projecting flange 83 is removed, by releasing the pressure from housings side "A" and "B," contact between the contact surfaces 15 and 16 is broken and the motor turns off.

When the motor 4 is activated by squeezing, as described above, a ribbon or other tether 3 reels in and becomes wound on the reel 142. As soon as the user stops squeezing the housing 8, the elastically deformable material of the housing 8 flexes back to its unpressured state and the motor 4 turns off because the contact switch 6 is no longer depressed (activated). This causes the lift from a lighter-than-air gas in the balloon to pull the tether 2 upwardly, acting similarly to a "motor," thereby reeling the ribbon out in the opposite direction. Both the lift of the balloon 13 and the "free spinning" design of the motor shaft allow the ribbon 5 to unwind or spin outwards and upwards toward the sky.

Figure 4A:
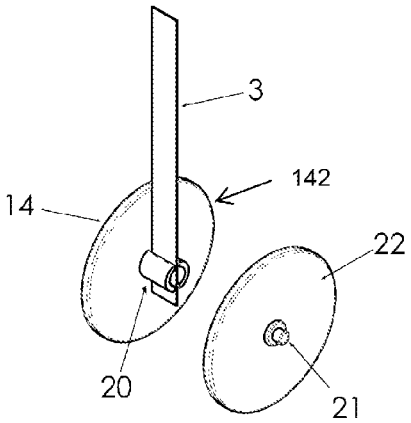
FIG. 4A is a perspective view of a ribbon and reel assembly.
Figure 4C:
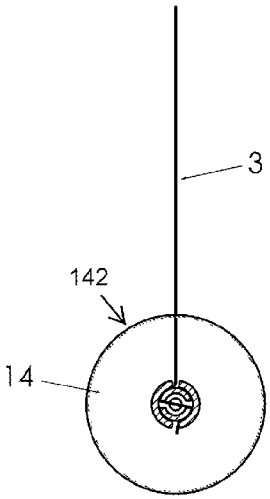
FIG. 4C is a cross-sectional view along line A-A of FIG. 4B.
Figure 4B:
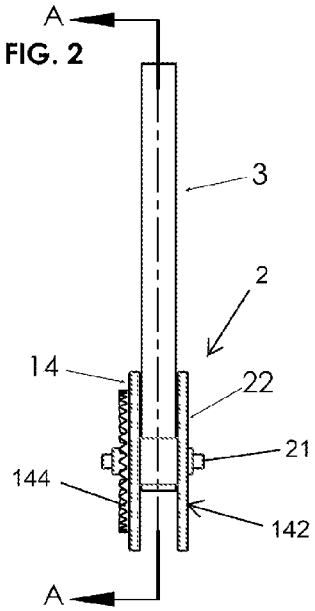
FIG. 4B is a side elevational view of the ribbon lock mechanism of the present device.

FIG. 4A is a perspective view of a ribbon 3 and reel assembly 2, showing gear side 14 with shaft end 20 having ribbon 3 extending through a slit in the center of shaft end 20 and reel section 22. Reel section gear side 14 and reel section 22 are joined at a center portion with a fixed axle 21 of the chassis 1, which secures the reel assembly 2 to the chassis 1. The reel parts are preferably made with a low friction material in order to reduce friction between the reel 142 and the axle 21 FIG. 4B is a side elevational view of the ribbon lock mechanism and shows reel section gear side 14, ribbon 3 and reel section 22 mated together. FIG. 4C is a cross-sectional view along line A-A of FIG. 4B of the spool cross section. When the reel section gear side 14 and ribbon 3 are combined with reel section 22, the reel assembly 2 has the ability to wind up the ribbon.

Figure 5A:
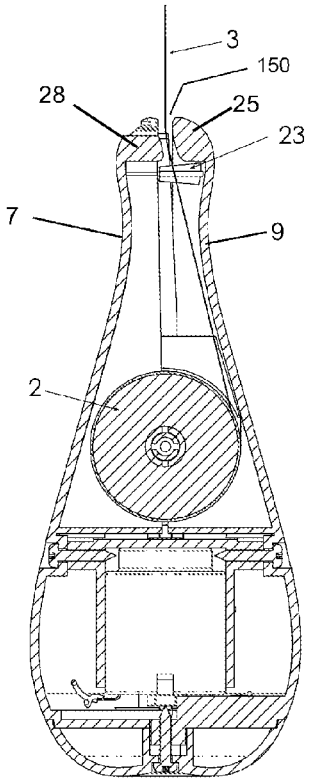
FIG. 5A is a cross-sectional view of the present device, showing the spool and ribbon guide assembly.
Figure 5B:
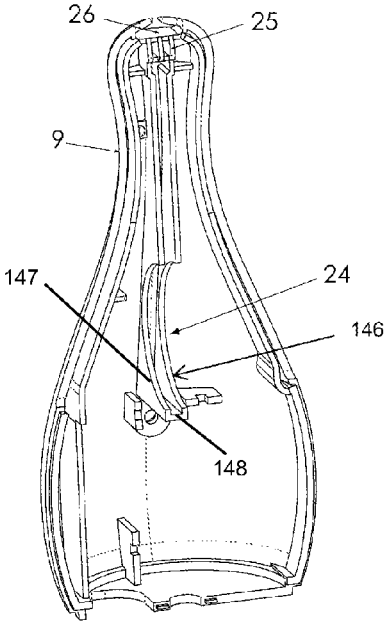
FIG. 5B is a perspective view of a first half of the housing of the present device.
Figure 5C:
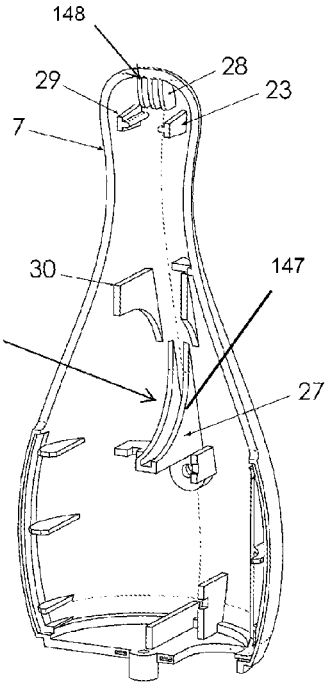
FIG. 5C is a perspective view of a second half of the housing of the present device.

FIG. 5A shows a cross section of reel assembly 2 with wound-up ribbon 3 and a guide 23. FIGS. 5B and 5C are perspective views of the interiors of housing sides "A" and "B," including a spool guide (24, 27), ribbon guides (23, 25, 28, 29) and a ribbon catch 26. The reel 142 is sized to fit within a spool guide 146 formed by spool guide "A" 24 and "B" 27, which provides ribbon tension to prevent ribbon 3 from bunching up and/or unwinding outside of the reel walls when the tension of the ribbon has slack. For example, gestural movements of the hand may cause the ribbon 3 to lose tension. Tension loss may also occur in the case when a balloon 37 hits a ceiling that is lower than the full length of the reeled out ribbon 3. In case of ribbon tension loss, the spool guide reduces the amount of slack to prevent ribbon tangling, bunching or escaping the spools walls. In the illustrated embodiments, the spool guide 146 comprises a pair of parallel, inwardly projecting vertical walls 147 spaced apart so as to accommodate the width of the reel 142 and a lower wall 148 for retaining the reel 142 within the spool guide 146.

Ribbon guide 148, formed in the illustrated embodiment by ribbon guide portion "A" 25 and ribbon guide portion "B" 28, comprises adjoining surfaces, in this case a plurality of surfaces formed on inwardly projecting flanges, which face each other and are shaped to contact the tether 3 across its width in order to prevent twisting of ribbon 3 when reeling it into the device 100, which also aids in reducing friction in the fully wound-up reel. The ribbon guide portion "A" 25 and ribbon guide portion "B" 28 are located adjacent to the opening in the housing and are preferably located on housing sides "A" and "B," respectively. The ribbon catch 26, which in the illustrated embodiment comprises a pair of inwardly projecting flanges, is used to hook the ribbon so it can be secured at any length while the motor 4 is not engaged. Ribbon guide "C" 29, ribbon guide "D" 23, and ribbon guide "E" 30 prevent the ribbon from moving from side to side while being reeled in and out, which helps prevent the ribbon 3 from twisting and reduces friction when reeling in and out. Ribbon guide "D" 23 also is used to activate the contact switching mechanism when the device is squeezed or pressed.

Figure 6A:
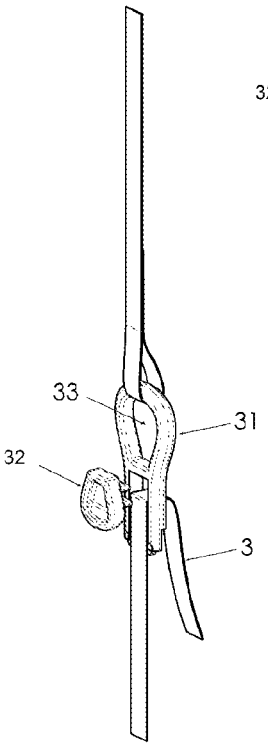
FIG. 6A is a perspective view of the ribbon clip of the present device with the lock removed.
Figure 6B:
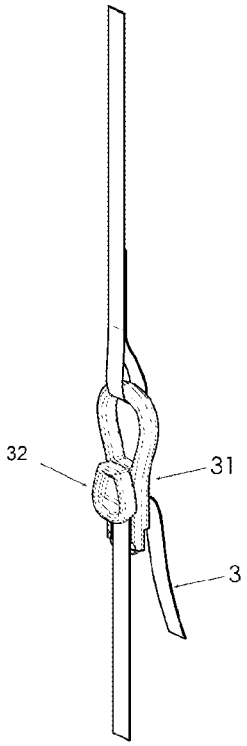
FIG. 6B is a perspective view of the ribbon clip with the lock in place.

FIG. 6A is a perspective view of a ribbon clip 31 for use with the present device 100, showing the clip's lock 32 removed. The clip 31 is used to adjust the length of a tether 3, which passes through the clip 31 and can be adjusted to any length. The lock 32 is used to secure ribbon 3 to clip 31 at a preferred length. Clip 31 is used to hold the ribbon in place, and also acts as a stopper to prevent the ribbon from being reeled into the device all the way. Clip 31 comprises loop 33 in order to fasten/or tie the ribbon 3 to the clip 31. Multiple balloon ribbons can be fastened to clip 31 to create a bouquet of balloons, for example. FIG. 6B is a perspective view of the ribbon clip with lock 32 in place, showing the lock 32, ribbon 3 and clip 31 fixed together at the desired length.

Figure 7A:
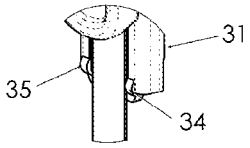
FIG. 7A is a perspective detail view of the ribbon clip.
Figure 7B:
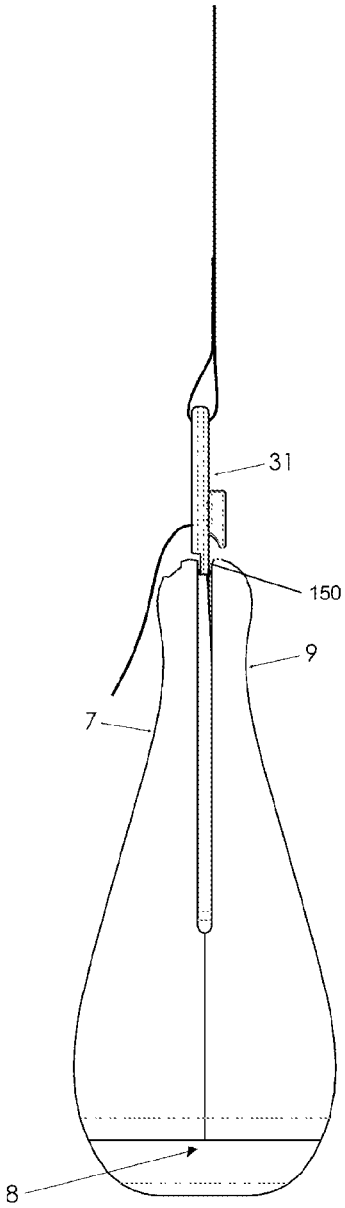
FIG. 7B is a side elevation view of the present device with the ribbon clip in the locked position.

FIG. 7A is a perspective detail view of the ribbon clip 31 showing the locking mechanism to the housing body 8. The ribbon clip 31 comprises ridge 34 and ridge 35 used for locking ribbon clip 31 into the housing body 8. FIG. 7B shows ribbon clip 31 in the locked position in which both winding and unwinding of the reel assembly 2 (not pictured) is prevented. When a proximal end of the clip 31 contacts the opening 150 or other portion of the housing 8, this stops further winding of the tether 3 on the reel 142. Advantageously, the proximal end of the clip 31 fits within the opening 150 of the housing 8 and is sized to be thick enough to stop the lateral sides of the housing (the "A" and "B" sides) from being brought into sufficient proximity when squeezed to cause contact surfaces 15 and 16 of the switch 6 to make an electrical connection. Placement of the proximal end of the clip 31 into the opening 150 of the housing thereby prevents activation of the motor. This prevents the device 100 from accidentally being activated.

Figure 8:
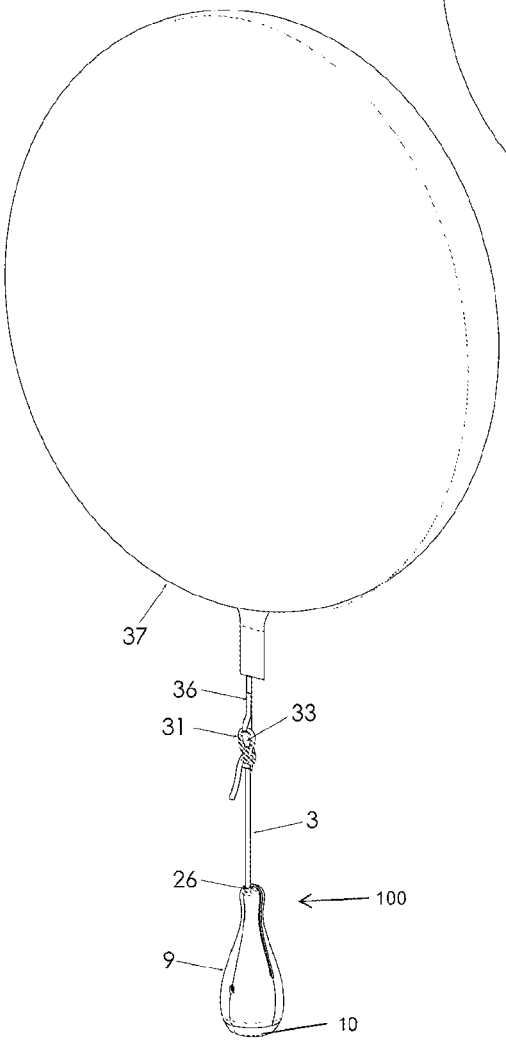
FIG. 8 is a perspective view of the present device standing with a balloon in the ribbon catch.

FIG. 8 is a perspective view of the housing body 8 with a balloon 37 in the ribbon catch 26. As shown in this figure, ribbon 3 extends through ribbon catch 26 on housing side "A" 9 and its second end is attached to clip 31. The first end of the balloon ribbon 36 is attached to loop 33 of clip 31 and the second end of balloon ribbon 36 is attached to a lighter-than-air balloon 37, for example a helium filled balloon. The balloon lift naturally unwinds the ribbon 3 from the reel to the ribbon's maximum length. The ribbon catch 26 is used to hook the ribbon 3 so it can be secured at any length while the device 100 is not engaged.

Figure 9:
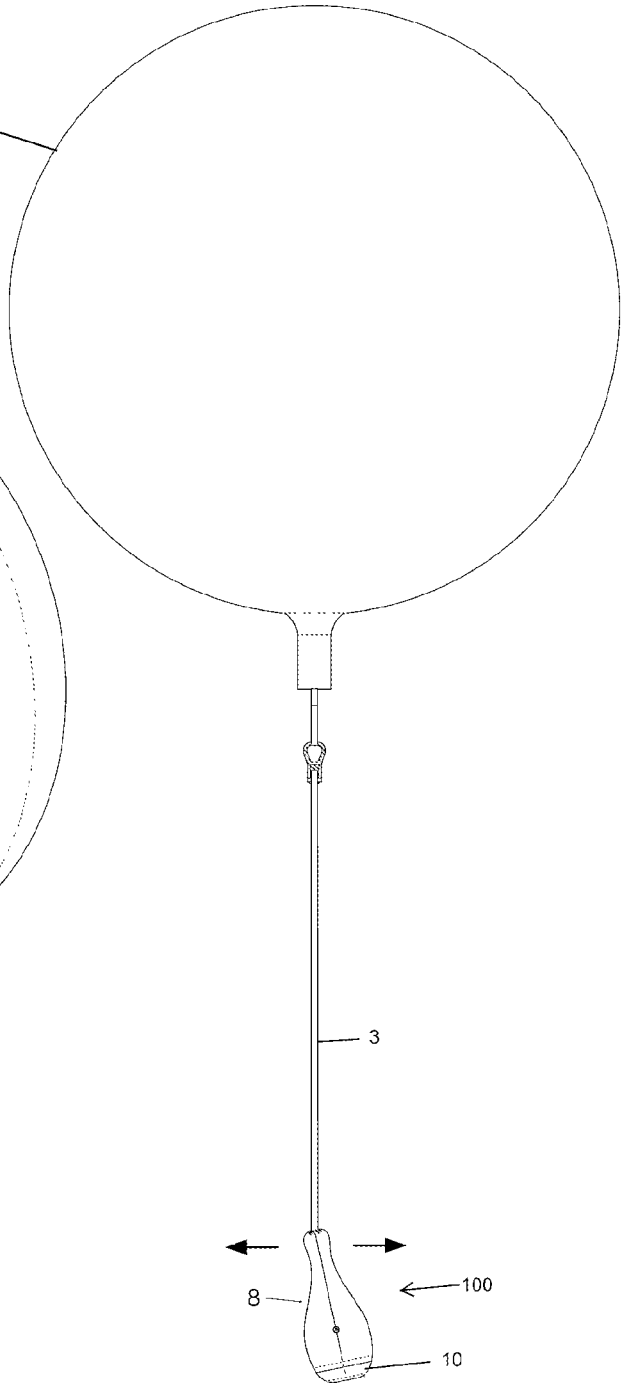
FIG. 9 is a side elevation view of the device wobbling with a balloon.

FIG. 9 is a side elevation view of housing body 8 wobbling with a balloon 37. At least a lower portion of the housing 8 is preferably ovoid in configuration and is weighted. By placing the motor 4 and preferably also the batteries 49 in the lower portion of the housing, the center of gravity of the device is located in the lower portion 84 of the device 100, thereby lowering the housing's center of gravity. In one embodiment, the center of gravity of the device 100 is lowered to such an extent that the device can return to an upright position on its own if tipped over. To accomplish this, the bottom portion of the housing, i.e. the portion contacting the ground when the housing is upright or tilted at an angle (preferably of 45° or less), is radiused (i.e., curved or rounded) so that the housing 8 of the device is tipable but will naturally move back to an upright position. Alternatively, the device 100 will return to an upright position when a lighter-than-air balloon is attached to an upper portion of the present device. The upward force placed on the upper portion of the device due to the lift of the balloon will return the device to an upright position. In the illustrated embodiments, the contact battery cover 10 is constructed with a convex center and an upward concave curved wall, creating a flat plane for the body 8 to rest in a standing position, but allowing the device 100 to wobble when movement of a balloon caused by environmental conditions, for example wind or a ceiling fan, rotates the body 8 about the central axis.

Figure 10A:
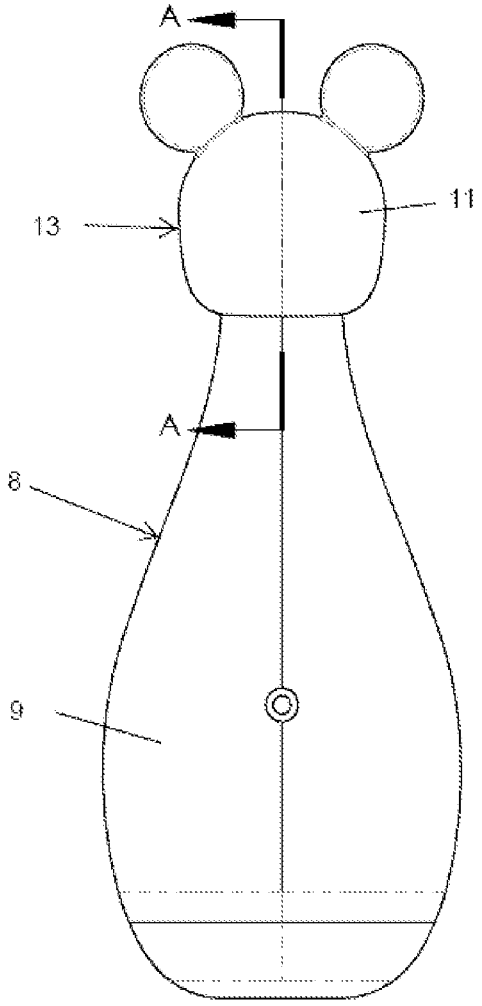
FIG. 10A is a front elevation view of the housing of the present device with a head attachment.
Figure 10C:
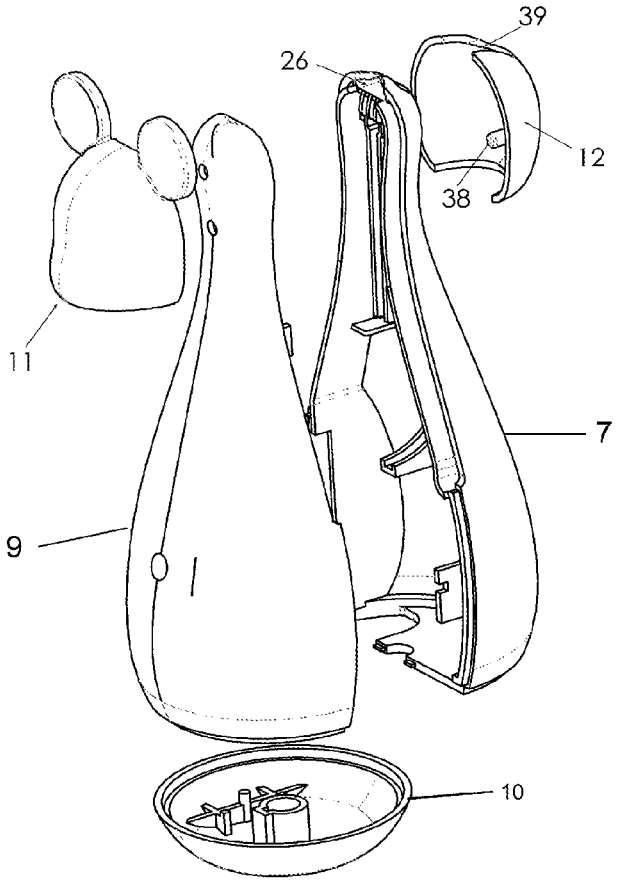
FIG. 10C is an exploded view of the housing and head attachment shown in FIG. 10A.

FIG. 10A is a rear elevation view of the housing body 8 of the present device 100 with a head attachment 13, which preferably can be detached and interchanged with a variety of other head part designs. As shown in FIG. 10C, a front head section 12 fits over an upper portion 82 of the housing 8, housing side "B" 7 in FIG. 10A, while a rear head section 11 mates with housing side "A" 9. The front head section 11 is constructed with an opening 39 to allow passage of the tether 3 therethrough, and preferably so as to not cover the ribbon catch 26.

Figure 10B:
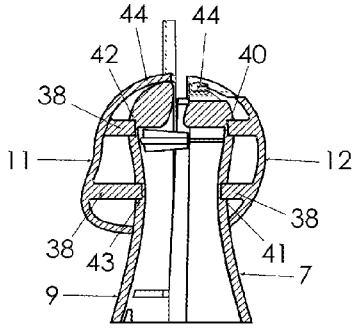
FIG. 10B is a cross-sectional view along line A-A of FIG. 10A.

FIG. 10B is a cross sectional view of the head parts 11, 12 attached to the housing body 8. Head front section 11 mates with housing side "B" 7 by inserting two elongated rod connectors 38 into cavity 40 and cavity 41 of housing side "B" 7. Rear head section 12 mates with housing side "A" 9 by inserting two elongated rod connectors 38 into cavity 42 and cavity 43 of housing side "A" 9 . The head parts 44 may be detached and interchanged with a variety of other head part designs, or may be permanently secured to the housing 8.

Figure 11:
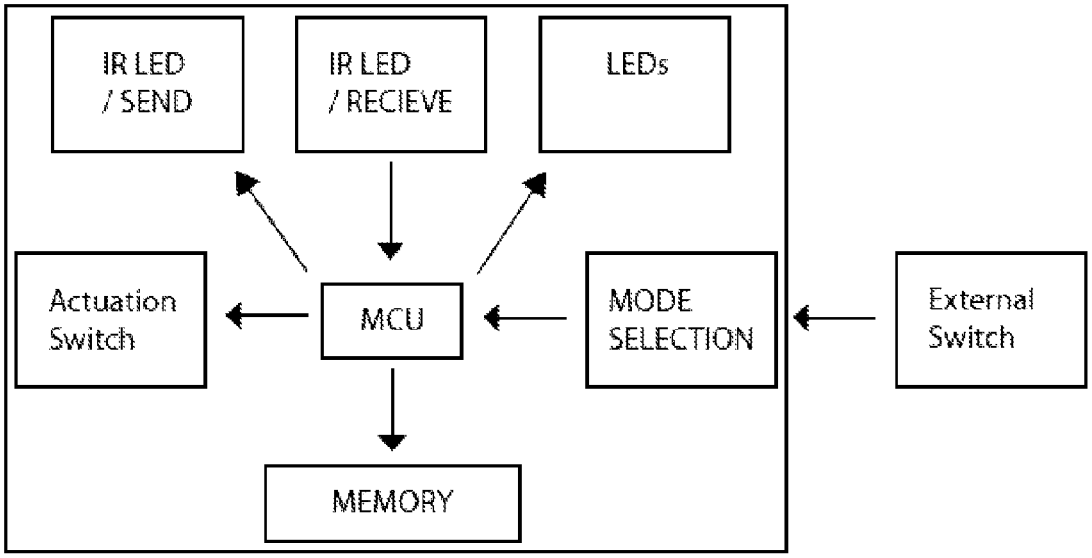
FIG. 11 is a schematic diagram of circuitry of the present device.

FIG. 11 is a schematic diagram of circuitry that can be used in the present device 100. A microcontroller unit (MCU) is activated from a mode selection unit which is in turn activated from an external switch. Each play mode is stored in the memory. The microcontroller unit can be designed to send and receive infrared light emitting diode signals with other similar devices. Depending on the signals sent and received, an actuation switch can turn on and off motors or light emitting diodes of the present device and/or a plurality of other devices in sequenced or choreographed patterns. For example, a plurality of units of the present device 100 can be moved up and down in synchronization, or the wobbling movement of the device can trigger flashing on and off of a light emitting diode on the present device 100. Each device 100 can be designed with a plurality of sensors capable of sensing, for example, changes in environmental conditions and/or determining the location of the device in an environment. For example, the device can assist in locating a child lost in a theme park by helping to determine the child's location, such as through inclusion of a global positioning system device in the present device 100. The device, in addition, can be used to play a number of common or new locative games such a tag, hide and seek, and treasure hunts.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. An interactive entertainment device for lighter-than-air balloons comprising:

(a) a tether having a first end connected to a balloon and a second end attached to a reel;

(b) a motor mechanically connected to the reel;

(c) a pressure-activated switch in electrical communication with the motor and an electrical source, wherein the motor is activated when an electrical connection is made between the motor and the electrical source; and (d) a housing for enclosing the pressure-activated switch, the motor and the reel, said housing comprising a first and a second curved sidewalls that are attached to each other at a first end of the housing and can move closer to each other upon the application of pressure at a second end of the housing, thereby activating the pressure-activated switch, wherein the housing further includes an opening in through which the tether extends, wherein the reel freely rotates around an axis in one direction so as to allow the tether to unwind in response to an upward force exerted by the rising of a lighter-than-air balloon, and moving the first and a second curved sidewalls closer to each other activates the motor and the motor rotates the reel around the axis in the opposite direction so as to wind the tether around the reel and lower the lighter-than-air balloon.

2. The device of claim 1, wherein the housing comprises a first lateral portion and a second lateral portion, wherein the first and second lateral portions are attached to form the housing.

3. An interactive entertainment device for lighter-than-air balloons comprising:

(a) a tether having a first end connected to a balloon and a second end attached to a reel;

(b) a motor mechanically connected to the reel;

(c) a pressure-activated switch in electrical communication with the motor, wherein the motor is activated when an electrical connection is made between the motor and the electrical source;

(d) a housing for enclosing the pressure-activated switch, the motor and the reel, said housing comprising a first and a second and having an opening in an upper portion through which the tether extends, wherein the housing comprises a first lateral portion and a second lateral portion, and wherein the first and second lateral portions are attached to form the housing; and (e) a clip having a proximal and a distal end, the proximal end of the clip being attached to the first end of the tether and being sized to fit within the opening in the upper portion of the housing and prevent movement of the first lateral portion and the second lateral portion of the housing toward each other, thereby preventing activation of the pressure activated switch, wherein the reel freely rotates around an axis in one direction so as to allow the tether to unwind in response to an upward force exerted by the rising of a lighter-than-air balloon, and wherein squeezing the housing activates the motor and the motor rotates the reel around the axis in the opposite direction so as to wind the tether around the reel and lower the lighter-than-air balloon.

4. The device of claim 3, wherein the distal end of the clip is attached to a second tether, the second tether being attached to a balloon.

5. The device of claim 2, wherein the tether is one of a ribbon, a rope, a cord, or a line.

6. The device of claim 5, further comprising one or more inwardly projecting flanges on the first lateral portion of the housing adjacent to the opening in the upper portion of the housing and one or more inwardly projecting flanges on the second lateral portion of the housing adjacent to the opening in the upper portion of the housing, wherein the flanges on the first lateral portion face the flanges on the second lateral portion and help to prevent twisting of the ribbon.

7. The device of claim 2, wherein each of the first lateral portion and the second lateral portion of the housing comprises a pair of parallel, inwardly projecting vertical walls spaced apart so as to accommodate the reel and a lower wall for retaining the reel, thereby forming a spool guide.

8. The device of claim 1, wherein at least the upper portion of the housing is formed from an elastically deformable material, wherein the application of pressure to the upper portion of the housing results in lateral movement of the inwardly projecting flange and causes the separated contact surfaces to come into electrical communication.

9. The device of claim 1, wherein the electrical source comprises one or more batteries enclosed within the housing.

10. The device of claim 1, wherein the motor further comprises a drive shaft having teeth at a distal end, and wherein the drive shaft teeth mesh with teeth disposed on the reel, thereby driving rotation of the reel by the motor.

11. The device of claim 1, further comprising a covering for the upper portion of the housing 7, the covering including an opening to allow passage of the tether therethrough.

12. The device of claim 1, wherein the housing's center of gravity is located in the lower portion of the housing, the lower portion comprising radiused lower edges on an exterior surface so that the device can return to an upright position if tipped over.

13. The device of claim 1, wherein the reel comprises a circular flange with gear-teeth.

14. The device of claim 1, further comprising a clip having a proximal and a distal end, wherein the distal end of the clip is attached to a second tether, the second tether being attached to a balloon.

15. The device of claim 1, further comprising a spool guide for housing the tether.

16. The device of claim 1, further comprising a spool guide for housing the tether and a tether guide connected to the housing between said spool guide and the opening in an upper portion of the housing through which the tether extends.

17. The device of claim 1, wherein the housing further comprising a lower cover having a convex center and an upward concave curved wall.

18. An interactive entertainment device for lighter-than-air balloons comprising:

(a) a tether having a first end connected to a balloon and a second end attached to a reel;

(b) a motor mechanically connected to the reel;

(c) a pressure-activated switch in electrical communication with the motor and an electrical source, wherein the motor is activated when an electrical connection is made between the motor and the electrical source; and (d) a housing having an elastically deformable portion for enclosing the pressure-activated switch, said housing further including an opening in an upper portion through which the tether extends, wherein the reel freely rotates around an axis in one direction so as to allow the tether to unwind in response to an upward force exerted by the rising of a lighter-than-air balloon connected to the tether, and wherein squeezing the elastically deformable portion of the housing activates the motor and the motor rotates the reel around the axis in the opposite direction so as to wind the tether around the reel and lower the lighter-than-air balloon.

* * * * *